US006847797B2

(12) United States Patent
Nishihama et al.

(10) Patent No.: US 6,847,797 B2
(45) Date of Patent: Jan. 25, 2005

(54) CHARGING APPARATUS HAVING AUXILIARY CHARGER RUBBING AGAINST IMAGE BEARING MEMBER

(75) Inventors: Tadayoshi Nishihama, Chiba (JP); Tokihiko Ogura, Chiba (JP); Hisataka Hisakuni, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/617,669

(22) Filed: Jul. 14, 2003

(65) Prior Publication Data

US 2004/0018029 A1 Jan. 29, 2004

(30) Foreign Application Priority Data

Jul. 25, 2002 (JP) ..... 2002-217126

(51) Int. Cl.[7] ..... G03G 15/02

(52) U.S. Cl. ..... 399/174; 361/221; 361/225; 399/50; 399/128; 399/159; 430/902

(58) Field of Search ..... 399/174, 175, 399/176, 149, 150, 50, 128, 129, 159; 361/221, 225; 430/902, 56

(56) References Cited

U.S. PATENT DOCUMENTS

| | | | | |
|---|---|---|---|---|
| 4,472,491 A | | 9/1984 | Wiedemann | 430/59.6 |
| 4,851,960 A | | 7/1989 | Nakamura et al. | 361/225 |
| 5,391,449 A | | 2/1995 | Maruyama et al. | 430/66 |
| 5,659,854 A | * | 8/1997 | Masuda et al. | 399/176 |
| 5,751,405 A | * | 5/1998 | Aita et al. | 399/150 |
| 5,842,081 A | * | 11/1998 | Kaname et al. | 399/50 |
| 5,881,343 A | * | 3/1999 | Momotani et al. | 399/174 |
| 6,023,597 A | * | 2/2000 | Mayuzumi et al. | 399/176 |
| 2003/0235419 A1 | * | 12/2003 | Ota | 399/50 |

FOREIGN PATENT DOCUMENTS

| | | |
|---|---|---|
| JP | 51-66834 | 6/1976 |
| JP | 57-178267 | 11/1982 |
| JP | 57-207258 | 12/1982 |
| JP | 58-40566 | 3/1983 |
| JP | 63-149669 | 6/1988 |
| JP | 4-226469 | 8/1992 |
| JP | 08-050396 | * 2/1996 |
| JP | 2000-284570 | * 10/2000 |

* cited by examiner

*Primary Examiner*—Sophia S. Chen
(74) *Attorney, Agent, or Firm*—Fitzpatrick, Cella, Harper & Scinto

(57) ABSTRACT

A charging apparatus has a movable image bearing member, a first charging member for charging the image bearing member, and a second charging member provided upstream of the first charging member with respect to the direction of movement of the image bearing member, the second charging member having an elastic rotary member rubbing against the image bearing member.

5 Claims, 4 Drawing Sheets

CHARGING APPARATUS HAVING AUXILIARY CHARGER RUBBING AGAINST IMAGE BEARING MEMBER

BACKGROUND OF THE INVENTION

1. Field of the Invention

The invention relates to a charging apparatus suitably used in an image forming apparatus of an electrophotographic type for charging an image bearing member such as a photosensitive member.

2. Description of Related Art

In an image forming apparatus of an electrophotographic type, a corona charger has heretofore been used as charging means for a photosensitive member. In this method, however, corona products such as ozone and nitrogen oxides are produced during the generation of corona, and these adhere to the surface of the photosensitive member or deteriorate the surface of the photosensitive member. Therefore, the spread of an image or a faint image has been caused or the stains of a corona wire have caused the non-uniformity of charging to thereby cause a faulty image such as the blank area or black line of an image.

In recent years, however, owing to such merits as low ozone and low electric power, a contact charging apparatus, i.e., an apparatus of a type in which a charging member having a voltage applied thereto is brought into contact with a photosensitive member to thereby effect the charging of the photosensitive member, has been proposed, for example, in Japanese Patent Application Laid-Open No. 57-178267, Japanese Patent Application Laid-Open No. 58-40566, etc. and has been put into practical use. Specifically, charging is effected by gap discharge caused in a minute gap between a charging member and a photosensitive member by a voltage of the order of 1 to 2 kV being applied to between the charging member and the photosensitive member.

Accordingly, a voltage equal to or greater than a certain threshold value voltage is applied, whereby charging is started, and a predetermined DC voltage is applied, whereby the photosensitive member can be charged. However, in a method wherein only a DC voltage is applied, the resistance value of the contact charging member is fluctuated by the fluctuations of the temperature and humidity around an image forming apparatus and the photosensitive member is shaved by being repetitively used, whereby the film thickness thereof is changed and a charging voltage is fluctuated and therefore, it has been difficult to bring the potential of the photosensitive member to a desired value.

Therefore, in order to achieve the further uniformity of charging, use is made of a method as disclosed, for example, in Japanese Patent Application Laid-Open No. 63-149669, etc. wherein a vibration voltage comprising an AC component having a peak-to-peak voltage twice or more as great as a discharge threshold value voltage and superimposed upon a DC voltage corresponding to a desired charging voltage is applied to. a contact charging member to thereby effect the charging of a photosensitive member. This is directed to the uniformizing effect of potential by the application of an AC voltage, and the potential of the photosensitive member converges into the applied DC voltage and is not affected by such extraneous factors as the environment and the shaving of the photosensitive member.

Also, in contact charging, an apparatus of a roller charging type particularly using a roller-shaped charging roller as a charging member is preferably used from the viewpoint of the safety of charging. In the contact charging apparatus of the roller charging type, an elastic roller (charging roller) having electrical conductivity as the charging member is brought into pressure contact with the photosensitive member, and a voltage is applied thereto to thereby charge the photosensitive member. As described above, by using a charging process of the so-called contact charging type in which the electrically conductive member is brought into contact with the surface of the photosensitive member, and a voltage is applied to the electrically conductive member, the production of ozone has become little and the charging by low electric power has become possible. Further, by the method of applying a vibration voltage of (direct current+alternating current) to the charging member, it has become possible to effect stable and uniform charging.

Even in such a contact charging apparatus, however, the essential charging mechanism uses a discharging phenomenon from the charging member to the photosensitive member and therefore, a slight amount of ozone is produced. Also, discharge occurs near the surface of the photosensitive member and therefore, damage to the surface of the photosensitive member by charging becomes greater than that in the case of corona charging. Further, when use is made of a method of superimposing an AC voltage for the uniformization of charging, it has posed a problem for the deterioration of the surface of the photosensitive member to become more remarkable due to a further increase in the amount of produced ozone and an increase in discharge.

Particularly, in an OPC photosensitive member using an organic photoconductor (OPC) as the photosensitive member, the damage to the surface of the photosensitive member by contact charging is remarkable and as compared with corona charging, the shaving of the photosensitive member during the repetitive use thereof in the case of contact charging is very great and accordingly, there has arisen the problem of the service life of the photosensitive member becomes short.

On the other hand, as an attempt to extent the service life of the photosensitive member, an attempt to form the surface layer of the photosensitive member by resin hardened by light or heat, and increase the surface hardness to thereby decrease the shaving is shown, for example, in Japanese Patent Application Laid-Open Nos. 51-66834, 57-207258, and 4-226469, etc.

However, when the photosensitive member having its surface layer formed by the hardenable resin, as described above, is used in an image forming apparatus effecting contact charging, the shaving is very little, but when image forming is repetitively effected under a high-temperature high-humidity environment, there has been the problem that it is difficult to shave and remove any discharge product adhering to the surface of the photosensitive member by discharge and therefore the resulting image becomes faint.

SUMMARY OF THE INVENTION

It is an object of the present invention to provide a charging apparatus in which the production amount of ozone is small.

It is another object of the present invention to provide a charging apparatus in which a discharge product on the surface of an image bearing member can be removed by a charger.

It is still another object of the present invention to provide a charging apparatus having a movable image bearing member, a first charging member for charging the image bearing member, and a second charging member provided upstream of the first charging member with respect to the direction of movement of the image bearing member, the second charging member having an elastic rotary member rubbing against the image bearing member.

Further objects of the present invention will become apparent from the following description.

DETAILED DESCRIPTION OF THE PREFERRED EMBODIMENTS

Figure 1:
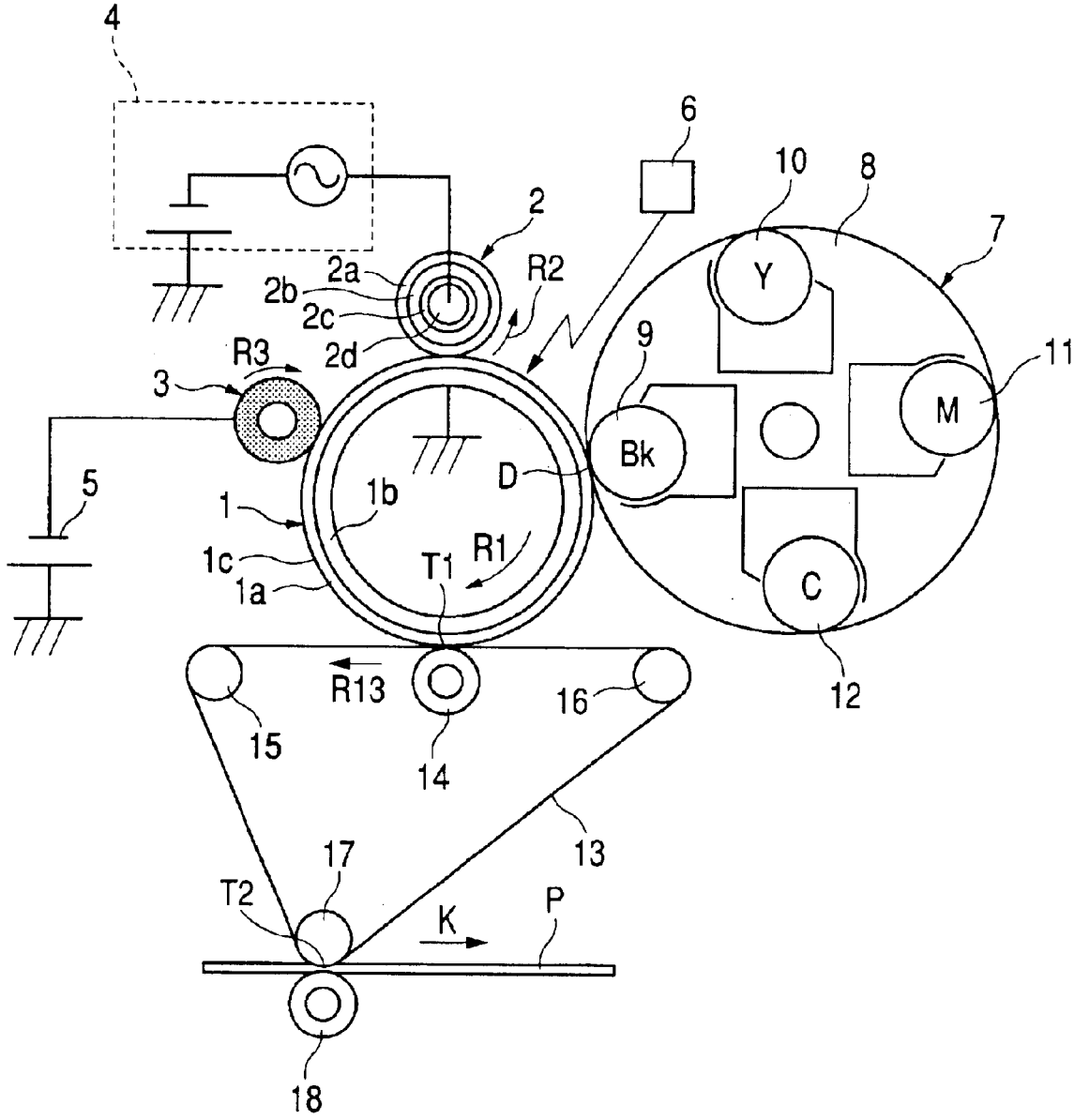
FIG. 1 is a vertical cross-sectional view schematically showing the construction of an image forming apparatus according to a first embodiment of the present invention.

Some embodiments of the present invention will hereinafter be described with reference to the drawings. In the drawings, like reference characters designate members similar in construction or action, and duplicate description of these is suitably omitted.

(First Embodiment)

FIG. 1 shows an image forming apparatus according to a first embodiment as an example of the image forming apparatus according to the present invention. The image forming apparatus shown in FIG. 1 is a four-color, full-color copying machine of an electrophotographic type using an intermediate transferring belt (intermediate transferring member, and FIG. 1 is a vertical cross-sectional view schematically showing the construction thereof. The copying machine shown in FIG. 1 is designed as a digital compound machine having, besides the copying function, a printer function and a facsimile function.

As shown in FIG. 1, the copying machine (hereinafter referred to as the image forming apparatus) is provided with a drum-shaped electrophotographic photosensitive member (hereinafter referred to as the photosensitive drum) as an image bearing member. The photosensitive drum 1 has an electrically conductive drum base (support member) 1*b* of aluminum or the like, and a photoconductive layer (photosensitive layer) 1*a* formed on the outer peripheral surface thereof, and is formed into a cylindrical shape having an outer diameter of 62 mm.

The film thickness of the photoconductive layer 1*a* is about 15 μm, and the uppermost protective layer 1*c* is formed into a layer thickness equal to or greater than 2 μm and equal to or less than 10 μm. The protective layer 1*c* is a protective layer containing at least one (hardenable resin and/or a charge transport compound) of hardenable resin and a charge transport compound, and hardened by at least one of heat, light and radiation.

The taper abrasion wear of the protective layer 1*c* is 0.1 to 1.0 (mg/1000 revolutions). The test of taper abrasion was carried out by mounting a sample on the sample stand of a taper abrasion tester (Y.S.S. Taber produced by Yasuda Works, Ltd.), applying a load of 500 g to each of two rubber abrasion rings (CS-0) having a wrapping tape (produced by Fuji Photo Film Co., Ltd., and trade name: C2000) mounted on the surface thereof, and measuring a decrease in the weight of the sample after 1,000 revolutions by a precision balance.

The photosensitive drum 1 is rotatively driven in the direction indicated by the arrow R1 at a predetermined process speed (peripheral speed), e.g. a peripheral speed of 200 mm/sec.

A main charging roller 2 having a diameter of 16 mm as a first charging member is disposed opposite to the photosensitive drum 1. The main charging roller 2 has a mandrel 2*d*, an elastic electrically conductive layer 2*c* formed on the outer peripheral surface thereof, a resistance adjusting layer 2*b* formed on the outer peripheral surface of the elastic electrically conductive layer 2*c*, and a surface layer 2*a* formed of acryl or fluorine resin. The main charging roller 2 has the lengthwisely opposite end portions of its mandrel 2*d* rotatably supported by bearing members (not shown), and is disposed toward the lengthwise direction of the photosensitive drum 1 and in parallelism thereto. The main charging roller 2 is pressed against the surface of the photosensitive drum 1 with a predetermined pressure force by pressing means (not shown), and is rotated in the direction indicated by the arrow R2 with the rotation of the photosensitive drum 1 in the direction indicated by the arrow R1.

An auxiliary charging roller 3 is disposed upstream of the main charging roller 2 with respect to the direction of rotation of the photosensitive drum 1. The auxiliary charging roller 3 is a roller-shaped member having a diameter of 16 mm, and is pressed against the surface of the photosensitive drum 1 with a pressure force of 1 to 2 kg by pressing means (not shown). The auxiliary charging roller 3 is rotatively driven in a counter direction (the direction indicated by the arrow R3) to the surface of the photosensitive drum 1 at a peripheral speed of 25% to 100% of the peripheral speed of the photosensitive drum 1 by driving means (not shown). The auxiliary charging roller 3 is a roller of foamed sponge rubber (foamed rubber material) having zinc oxide (ZnO) or carbon (C) dispersed therein and given electrical conductivity, and has a resistance value of $10^7$ to $10^9\Omega$ (this resistance value is the resistance value between the mandrel and surface of the charging roller) and hardness of 20~40 degrees (Asker C hardness).

A charging voltage source 4 is connected to the mandrel 2*d* of the main charging roller 2, and a charging bias is applied from this charging voltage source 4 to the main charging roller 2 which is a member to be charged, whereby the main charging roller 2 uniformly charges the outer peripheral surface (surface) of the photosensitive drum 1 to a predetermined polarity and potential. In the present embodiment, a voltage comprising a sine wave AC bias of a frequency of 1350 Hz and a peak-to-peak voltage Vpp of 1.5 kV superimposed upon a DC constant voltage of −700V is applied to the main charging roller 2 so that when the surface of the photosensitive drum 1 arrives at a developing position D, the main charging roller may reach −700V.

Also, a DC voltage of −1000V which is a charging bias for auxiliary charging synchronized with the bias to the main charging roller is applied from an auxiliary charging voltage source 5 to the auxiliary charging roller 3.

On the photosensitive drum 1 charged by double charge as described above, there is formed an electrostatic latent image corresponding to desired image information by an exposing apparatus (exposing means) 6. A developing apparatus 7 develops this electrostatic latent image. The double charge refers to charging which effects both of the auxiliary charging by the auxiliary charging roller 3 and the main charging by the main charging roller 2, and in contrast with this, single charge refers to the charging by the main charging alone which does not effect the auxiliary charging.

The developing apparatus 7 is provided with a rotatable rotary 8 and four developing devices mounted thereon, i.e., developing devices 9, 10, 11 and 12 containing therein black (Bk), yellow (Y), magenta (M) and cyan (C) toners, respectively. Design is made such that a developing device for a color used for the development of the electrostatic latent image formed on the photosensitive drum 1 is disposed at the developing position D opposed to the surface of the photosensitive drum 1, by the rotation of the rotary 8. Nonmagnetic two-component developers each having a toner and a carrier made by e.g. a polymerizing method are contained in the developing devices 9, 10, 11 and 12 for respective colors, and the toners are made to adhere to the above-described electrostatic latent image to thereby develop the electrostatic latent image as a toner image.

The toner image formed on the photosensitive drum 1 by the above-described developing device 7 is carried to a primary transferring position (primary transferring portion) T1 with the rotation of the photosensitive drum 1 in the direction indicated by the arrow R1, and is transferred to an intermediate transferring belt (intermediate transferring member) 13 as other member. The intermediate transferring belt 13 is an endless belt formed of synthetic resin such as Polyimide or polyvinylidene fluoride (PDVF), and is passed over a driving roller 15, a driven roller 16 and a secondary transferring opposed roller 17 and is rotatively driven in the direction indicated by the arrow R13 by the rotation of the driving roller 15. The intermediate transferring belt 13 is brought into contact with the surface of the photosensitive drum 1 by a primary transferring roller 14, and this contact portion becomes the primary transferring position T1. A primary transferring bias opposite in polarity to the toner image on the photosensitive drum 1 is applied to the primary transferring roller 14 by a primary transferring bias voltage source (not shown), whereby the toner image on the photosensitive drum 1 is primary-transferred onto the intermediate transferring belt 13.

The charging by the auxiliary charging roller 3 and the main charging roller 2, the exposure by the exposing apparatus 6 and the developing by the developing apparatus 7 described above are repeated for each of yellow, magenta, cyan and black, and toner images of the respective colors formed on the photosensitive drum 1 are successively primary-transferred onto the intermediate transferring belt (intermediate transferring member) 13 as other member. Thereby the toner images of the four colors are superimposed one upon another on the intermediate transferring belt 13.

The toner images of the four colors thus formed on the intermediate transferring belt 13 are secondary-transferred at a secondary transferring position (secondary transferring portion) T2. A secondary transferring roller 18 is brought into contact with that portion of the intermediate transferring belt 13 which is passed over the secondary transferring opposed roller 17, and the secondary transferring position T2 is formed between the intermediate transferring belt 13 and the secondary transferring roller 18. A recording material P, which moves in a direction indicated by the arrow K, is supplied from a feeding cassette (not shown) to this secondary transferring position T2. The recording material P contained in the feeding cassette is supplied to the secondary transferring position T2 in such a manner as to be timed with the toner images on the intermediate transferring belt 13 by a feed roller, conveying rollers and registration rollers (all not shown). At this time, a secondary transferring bias is applied to the secondary transferring roller 18 by a secondary transferring bias voltage source (not shown), whereby the toner images of the four colors on the intermediate transferring belt 13 are collectively secondary-transferred onto the recording material P.

After the transfer of the toner images, the recording material P is separated from the intermediate transferring belt 13 and is conveyed to a fixing device (not shown), where the recording material is subjected to heat and pressure, whereby the toner image is fixed on the surface thereof after the fixing of the toner image, in the case of one-side image forming, the recording material P is delivered to the outside of the main body of the image forming apparatus, and in the case of two-side image forming, the recording material P is conveyed from the fixing device to re-feeding means, from which the recording material P is supplied to the secondary transferring position T2, and image forming is also effected on the back side of the recording material P and after fixing, the recording material P is delivered to the outside of the image forming apparatus.

Any toners not transferred to the intermediate transferring belt 13 during the above-described primary transfer of the toner images but residual on the surface of the photosensitive drum 1 (transfer residuals such as residual toners, an extraneous additive and a discharge product) are forcibly stripped off from the surface of the photosensitive drum 1 by the auxiliary charging roller 3.

Here, in a conventional photosensitive drum of which the protective layer is relatively soft, when such forcible stripping-off of the transfer residuals is effected, the amount of shaving has become great and the life of the photosensitive drum has be comer short, but in the photosensitive drum of which the protective layer 1*c* is hard, as shown in the present embodiment, even when the forcible stripping-off of the transfer residual is effected, the amount of shaving is small and therefore, the forced stripping-off is possible.

In the above-described auxiliary charging roller 3, the outer peripheral portion thereof, i.e., the portion thereof that directly contacts with the surface of the photosensitive drum 1, is formed of porous foamed sponge. Therefore, it sufficiently has the effect of accumulating the transfer residuals thereon, but during the other time than the above-described forcible stripping-off operation or the image forming operation, an auxiliary charging bias or a discretely set suitable bias may be applied to the auxiliary charging roller 3 to thereby cause the transfer residuals accumulated on the surface of the auxiliary charging roller 3 to be gradually discharged onto the photosensitive drum 1, and be collected, for example, by the developing device 9 for black.

Also, before charging is effected by the main charging roller 2 during image forming, the surface of the photosensitive drum 1 is charged to a predetermined voltage Vpre. Assuming that the discharge starting voltage of the photosensitive drum 1 is about 500V, Vpre is about 500V because the auxiliary charging roller 3 applies −1000V.

Figure 2:
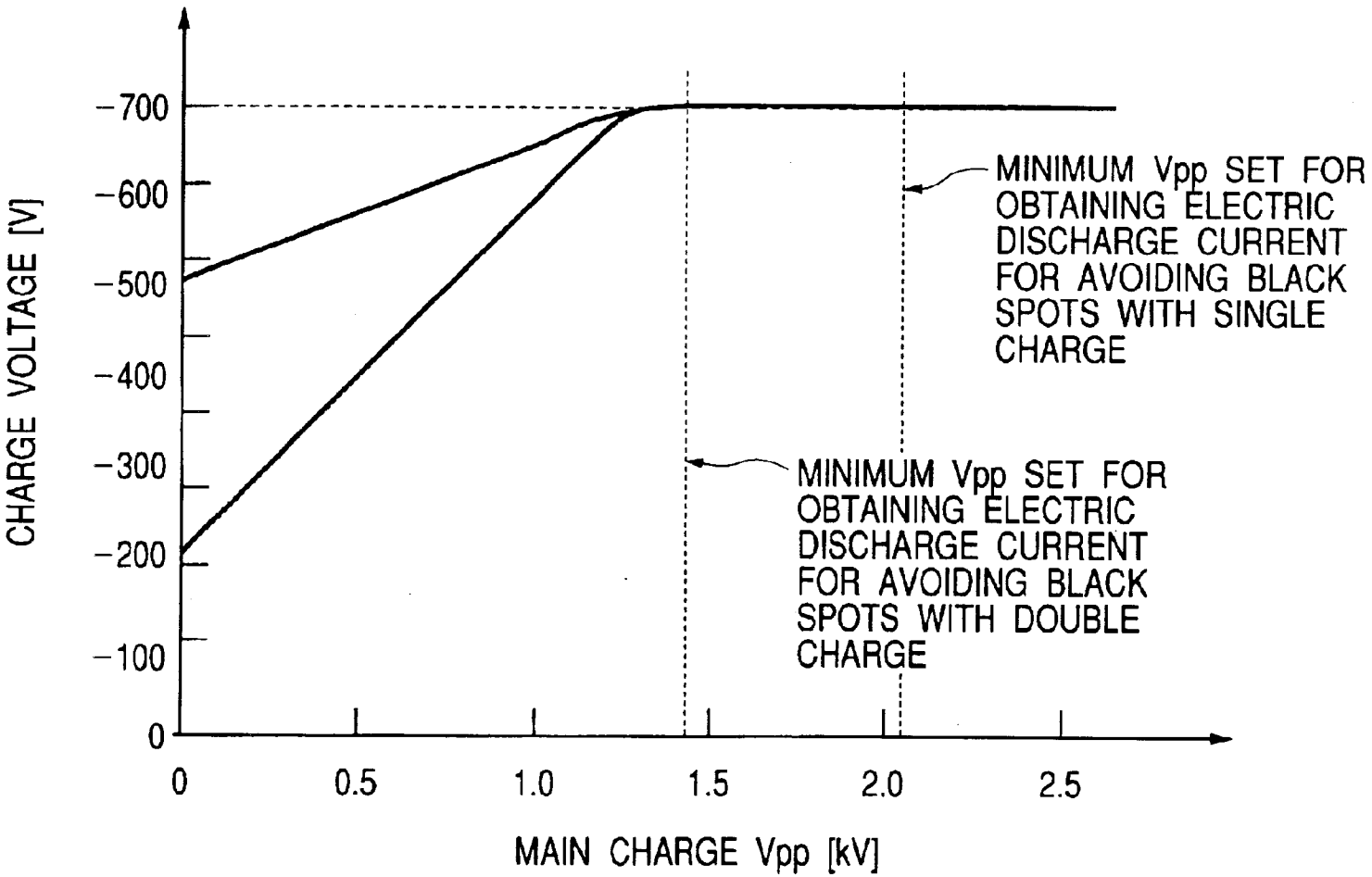
FIG. 2 shows the relation between the peak-to-peak voltage Vpp of an AC voltage applied to a main charging roller and the surface potential of a photosensitive member when auxiliary charging by an auxiliary charging roller is not effected before main charging by the main charging roller and when the auxiliary charging is effected.

FIG. 2 shows the relation between an AC voltage (Vpp) applied by the main charging roller and the charge voltage of the surface of the photosensitive drum when the auxiliary charging by the auxiliary charging roller 3 is not effected and when it is effected before the main charging by the main charging roller 2 is effected.

The charge voltage of the surface of the photosensitive drum when the main charge Vpp is raised rises from −200V when auxiliary charging is absent, but rises from −500V when auxiliary charging is present. Vpp converging to a desired a voltage −700 V becomes the same in both cases, and the discharge current also becomes the same in both cases.

The discharge current, however, is usually set to a level higher than a point at which the charge voltage is saturated, with black spots (sand) caused by the stains or abnormal discharge of the charging rollers, but by effecting auxiliary charging, an abnormal discharge starting current becomes low and therefore, correspondingly thereto, it becomes possible to lower the discharge current. In fact, the discharge current when auxiliary charging was absent was 100 to 150 μA, but by effecting auxiliary charging, the discharge current can be reduced to the order of ⅔ to ½. Accordingly, the frequency of occurrence of the discharge product is decreased, and it also becomes possible to suppress the deterioration of the surface layer of the photosensitive drum.

(Second Embodiment)

Figure 3:
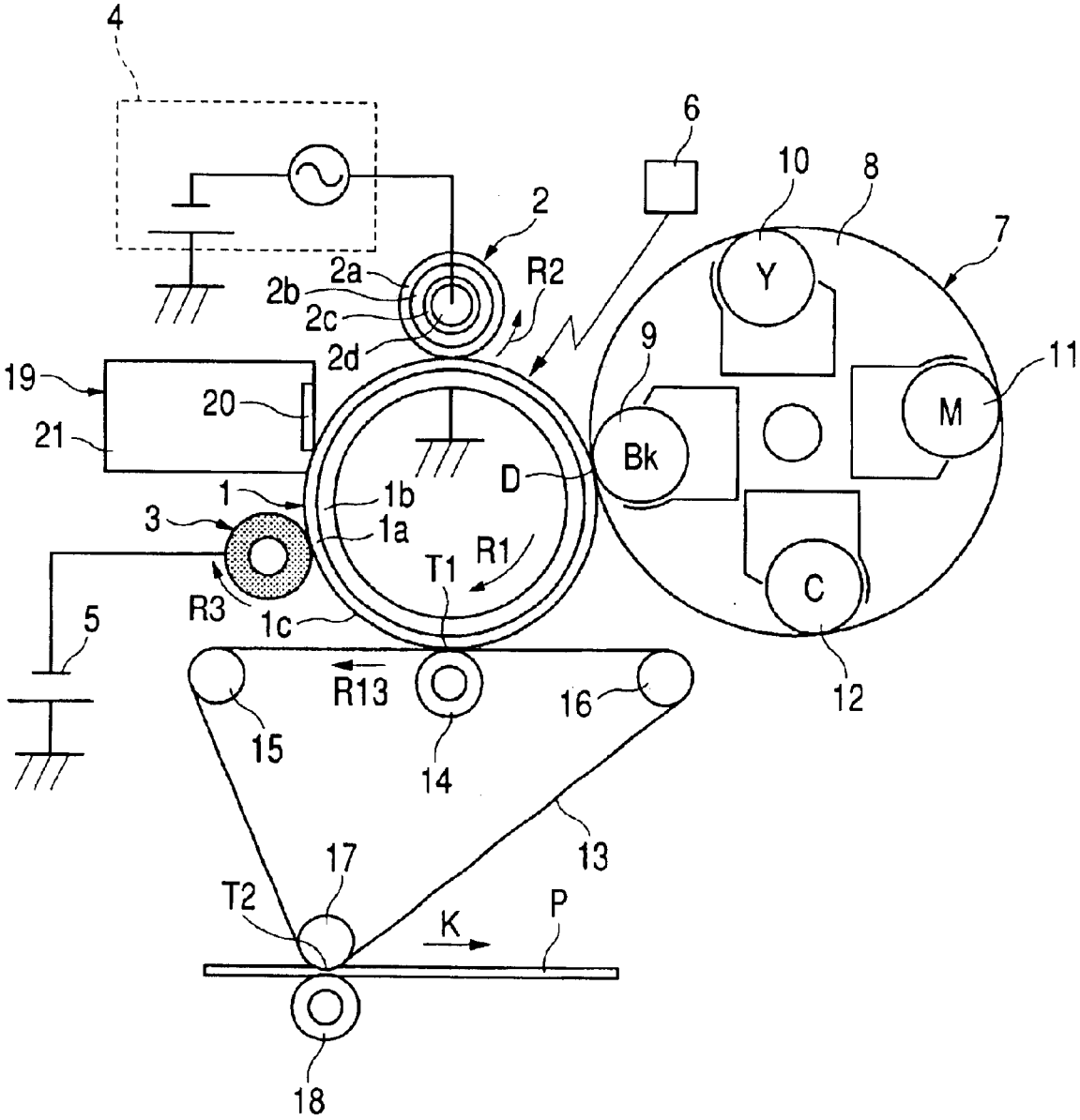
FIG. 3 is a vertical cross-sectional view schematically showing the construction of an image forming apparatus according to a second embodiment of the present invention.

FIG. 3 schematically shows the construction of an image forming apparatus according to a second embodiment. In this embodiment, members similar in function and construction to those in the above-described first embodiment are given the same reference characters and suitably need not be described.

The present embodiment is an improvement in the system shown in the first embodiment wherein a problem arises when the discharge of the transfer residuals accumulated on the surface layer of the auxiliary charging roller 3 are collected by the developing device.

The present embodiment adopts a magnetic single-component developing method (alias jumping developing) in which the developing device 9 for black effects developing by a magnetic position component developer. This is taken up as a typical example in which a problem arises when the vomits of the transfer residuals accumulated on the surface layer of the auxiliary charging roller 3 are collected by the developing device 9 for black, and the present invention is not restricted to a case where the magnetic single-component developing method is adopted.

The magnetic single-component developing method adopted in the present embodiment, unlike a two-component developing method, does not require a magnetic carrier and therefore does not require a carrier-toner mixing ratio control system and in addition, does not require carrier interchange or a automatic carrier interchanging apparatus due to the deterioration of the carrier, and this leads to a great feature of so-called maintenance-free which can simplify the construction of the developing devices (particularly an agitating and conveying construction). As a result, there are great merits such as a lower running cost, a reduction in the cost of the developing apparatus itself and the downsizing of the developing apparatus.

Also in a four-color, full-color image forming apparatus, the frequency of use of the developing device 9 for black by black characters is very high and therefore, the rate of use of the black toner included in a total output image is very high. For example, when the number of image forming sheets is a base, there is an investigation that Bk output total output (full-color output+Bk output) amounts to 0.5 to 0.9, and it is very effective in respect of a low running cost to make the developing device 9 for black maintenance-free.

On the other hand, as a demerit, it may be mentioned that in respect of charge impartment to the toner, the magnetic single-component developing method cannot rely on the charge impartment by the rubbing between the carrier and the toner, but relies chiefly on the rubbing in a developing blade portion used in case of thin toner layer coating of the developing roller and therefore, as compared with the two-component developing method, it is low in the charge impartment level of the toner. So, in the case of the magnetic single-component developing method, as a charge assisting agent, fine particles of titanate strontium or the like is generally added to the developer by 4% or so.

This charge assisting agent, however, increases its content in the transfer residual (hereinafter referred to as the waste toner) remaining on the photosensitive drum 1 after the transferring step, and further, by the rubbing between the toner and the charge assisting agent during transferring, cleaning, etc., the charge assisting agent is embedded into the toner and therefore, the charging characteristic of the waste toner exhibits a characteristic utterly different from that of the fresh toner in the developing device, and if this enters the developing device, the charge distribution of the toner carried on the developing roller will become extremely uneven, and there arises a phenomenon (alias contamination) in which it appears as unevenness on an image. Consequently, it is necessary to avoid collecting the discharges of the transfer residuals accumulated on the surface layer of the auxiliary charging roller by the developing device, and the present embodiment is improved in this point.

As shown in FIG. 3, in the present embodiment, a cleaning apparatus (cleaning means) 19 is provided upstream of the main charging roller 2 and downstream of the auxiliary charging roller 3 with respect to the direction of rotation of the photosensitive drum 1

The cleaning apparatus 19 has an elastic blade (a photosensitive member cleaning member) 20 and a cleaning container 21. The elastic blade 20 is a plate-like member formed into a rectangular shape, and has its upper end side supported by the cleaning container 21 and has one edge of its lower end which is a free end made to abut against the surface of the photosensitive drum 1 in a counter direction. Thereby, even if the transfer residual (waste toner) accumulated on the auxiliary charging roller 3 is discharged during other time than image forming, it can be wiped out by this elastic blade 20 and be collected into the cleaning container 21 and therefore, it becomes possible to prevent an uneven image (contamination) caused by the waste toner getting mixed in the developing device 9.

Also, in this construction, the auxiliary charging roller 3 upstream of the elastic blade 20 forcibly strips off the toner, the extraneous additive and firmly sticking discharge product on the photosensitive drum 1, and thereafter softly returns the stripped-off materials without causing them to be secured onto the photosensitive drum 1. Accordingly, as compared with the case described in connection with the conventional art that the auxiliary charging roller 3 is absent and the elastic blade alone is present, the abutting pressure of the elastic blade 20 against the photosensitive drum 1 can be reduced and therefore, such problems in durability as the chatter and wire edge of the elastic blade 20, and nicking of the blade itself can be solved.

(Third Embodiment)

Figure 4:
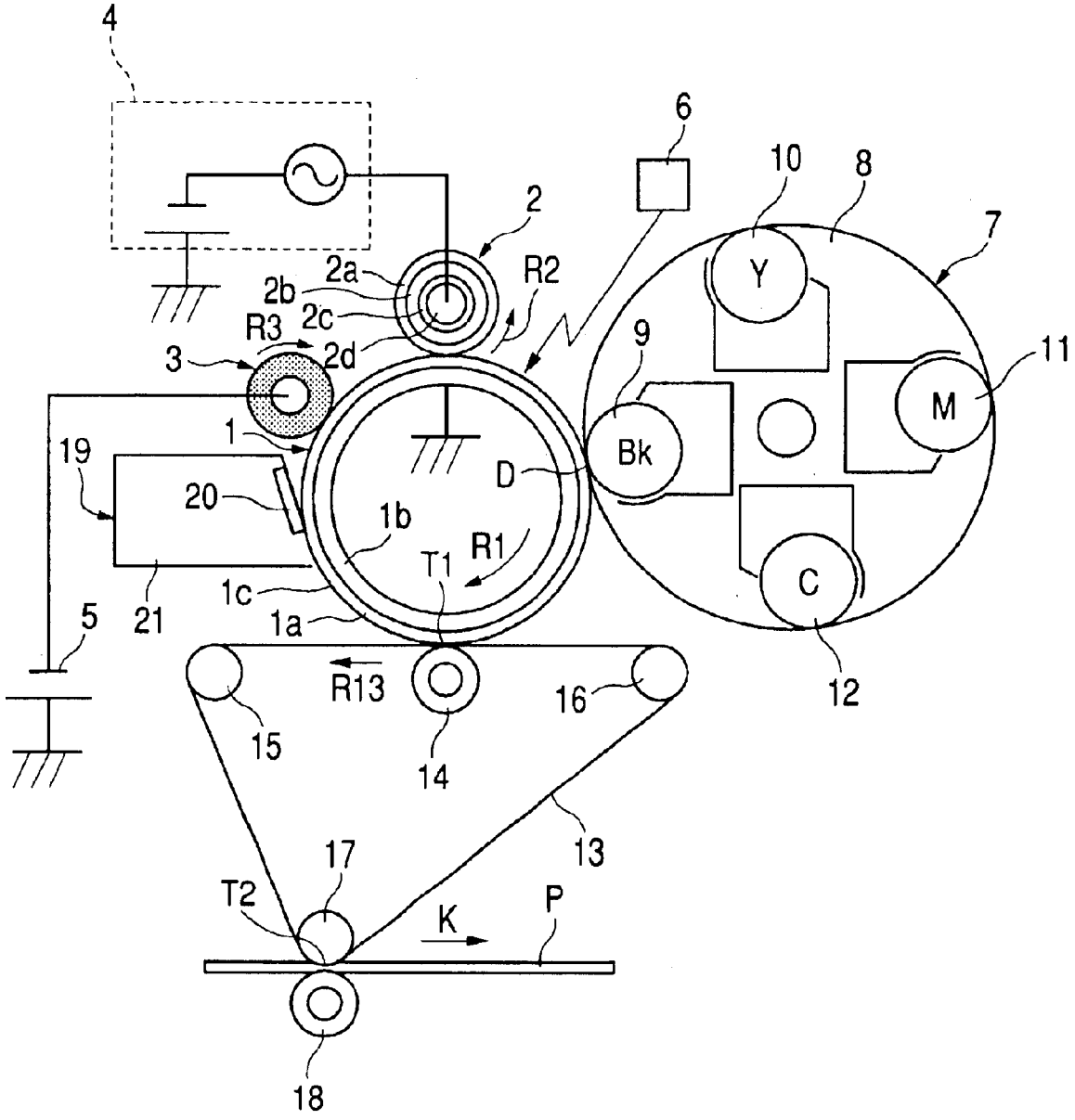
FIG. 4 is a vertical cross-sectional view schematically showing the construction of an image forming apparatus according to a third embodiment of the present invention.

FIG. 4 schematically shows the construction of an image forming apparatus according to a third embodiment. In this embodiment, members, etc. similar in function and construction to those in the above-described first and second embodiments are given the same reference characters and suitably need not be described.

The present embodiment is improved so that on the supposition that in the image forming apparatus according to the aforedescribed first embodiment, during a so-called jam such as a paper jam, the toner images developed on the photosensitive drum 1 are not transferred to the intermediate transferring belt 13, but arrive at the auxiliary charging roller 3 and the toner contamination of the auxiliary charging roller 3 occurs, the auxiliary charging roller 3 may not contaminated by the toners even during a jam.

In the present embodiment, as shown in FIG. 4, a cleaning apparatus 19 is disposed upstream of the auxiliary charging roller 3 and downstream of the primary transferring roller 14 with respect to the direction of rotation of the photosensitive drum 1. The construction of the cleaning apparatus 19 itself is similar to that shown in the above-described second embodiment and therefore need not be described.

In the present embodiment, the cleaning apparatus 19 is disposed at the above-described location and therefore, in a case where during a so-called jam such as a paper jam, the toner images developed on the photosensitive drum 1 have not been transferred, even when a great deal of toners are carried from the primary transferring position T1 with the rotation of the photosensitive drum 1, the toners can be wiped out by the elastic blade 20 of the cleaning apparatus 19 and be collected into the cleaning container 21 and thus, the extreme toner contamination of the auxiliary charging roller 3 can be prevented effectively.

When here, the cleaning of the surface of the photosensitive drum is to be effected by the elastic blade described in connection with the conventional art, it has been necessary to remove the discharge product which is the cause of a faint image by heightening the abutting pressure of the elastic blade. In this third embodiment, however, the auxiliary charging roller 3 is present downstream of the elastic blade 20, whereby the removal of the discharge product is possible.

Accordingly, in the present embodiment, there is adopted a construction in which the abutting pressure of the elastic blade 20 is reduced to thereby avoid such problems in durability as the chatter and wire edge of the elastic blade 20 and nicking of the blade itself and only the toners and the extraneous additive are removed, while on the other hand, the discharge product is stripped off by the auxiliary charging roller 3 present downstream of the elastic blade 20. That is, the functional separation concerning the cleaning is effected by the elastic blade 20 and the auxiliary charging roller 3.

Also, it has been confirmed as a result of studies that even if the discharge product adheres to the auxiliary charging roller 3, the charging characteristic thereof does not change. Consequently, the charging characteristics of the auxiliary charging roller 3 and the main charging roller 2 are stable in any case in spite of immediately after an environmental fluctuation and jam, and stable charging and further, stable image output become possible for a long period.

While in the above-described first to third embodiments, a description has been made by taking as an example a case where the image forming apparatus is four-color, full-color image forming apparatus, the present invention is not restricted thereto, but can of course also be applied to a single-color image forming apparatus.

According to the above-described first to third embodiments, in an image forming apparatus using a photosensitive drum 1 having a photosensitive layer 1*a* and a protective layer 1*c* on an electrically conductive drum base 1*b*, and increased in the life of the photosensitive drum 1 against the shaving thereof, there are provided a main charging roller (first charging member) 2 for effecting main charging, and an auxiliary charging roller (second charging member) 3 disposed upstream of the main charging roller 2 and downstream of a primary transferring roller (transferring means) 14 with respect to the direction of rotation of the photosensitive drum 1, and the auxiliary charging roller 3 is made to rub against the surface of the photosensitive drum 1 to thereby polish the surface of the photosensitive drum 1. Thereby, there are the operational effects that (a) a faint image under a high temperature and high humidity by the adherence of the discharge product to the surface of the photosensitive drum 1 can be prevented;

(b) there has heretofore been the problem that the life of the elastic blade 20 is short due to the chatter, wire edge and nicking of the blade occurring when the photosensitive drum 1 high in the hardness of the surface thereof is cleaned by the elastic blade, but according to the present invention, the elastic blade 20 can be positively eliminated, or when not eliminated, can be made low in its abutting pressure against the surface of the photosensitive drum 1 and therefore, the cleaning apparatus 19 can be given sufficient durability; and (c) a discharge current amount (charging current amount) for suppressing black spots (sand) due to abnormal discharge during charging can be reduced and therefore, the frequency of occurrence of the discharge product can be reduced and the deterioration of the surface of the photosensitive drum 1 can be suppressed.

Further, thereby, there can be achieved the effect that under any environment of low-temperature low-humidity to high-temperature high-humidity, good images can be outputted stably for a long period.

As described above, according to the present embodiment, the charging means has a first charging member for effecting main charging, and a second charging member disposed upstream of the first charging member and downstream of transferring means with respect to the direction of movement of the surface of a photosensitive member, and the second charging member is disposed so as to contact with the surface of the photosensitive member and rubs against the surface of the photosensitive member and therefore, even when a photosensitive member having high surface hardness is used, a discharge product can be polished and removed by the second charging member. Thereby, a faint image under a high temperature and high humidity can be prevented and an elastic blade for cleaning the photosensitive member can be eliminated, and when it cannot be eliminated, the abutting pressure of the elastic blade against the photosensitive member can be reduced to thereby extend the life of the photosensitive member and further, a discharge current amount (charging current amount) for suppressing black spots (sand) by abnormal discharge during charge can be reduced and therefore, the frequency of occurrence of the discharge product can be reduced and the deterioration of the surface of the photosensitive member can be suppressed. Thereby, there can be derived the effect that under any environment of low-temperature low humidity to high-temperature high-humidity, good images can be outputted stably for a long period.

While the embodiments of the present invention have been described above, the present invention is not restricted to these embodiments, but all modifications are possible within the technical idea of the present invention.

What is claimed is:

1. A charging apparatus to be used for forming an image by an electrophotographic process, said charging apparatus comprising:

a movable image bearing member, which has a photosensitive layer and a surface protecting layer covering said photosensitive layer;

a first charging member for charging said image bearing member; and a second charging member provided upstream of said first charging member with respect to a direction of movement of said image bearing member, said second charging member having an elastic rotary member rubbing against said image bearing member, wherein the surface protecting layer has a thickness of 2–10 $\mu$m, and a taper abrasion wear of 0.1 to 1.0 mg/1000 revolutions.

2. A charging apparatus according to claim 1, wherein said elastic rotary member has a foamed rubber surface layer.

3. A charging apparatus according to claim 2, wherein said foamed rubber surface layer has an Asker C hardness of 20–40 degrees.

4. A charging apparatus according to claim 3, wherein an electrical resistance of said foamed rubber surface layer is $10^7$ to $10^9\Omega$.

5. A charging apparatus according to claim 1, wherein a voltage comprising a direct current and an alternating current superimposed one upon the other is applied to said first charging member, and a direct current voltage is applied to said second charging member.

* * * * *

UNITED STATES PATENT AND TRADEMARK OFFICE

CERTIFICATE OF CORRECTION

PATENT NO. : 6,847,797 B2
DATED : January 25, 2005
INVENTOR(S) : Tadayoshi Nishihama It is certified that error appears in the above-identified patent and that said Letters Patent is hereby corrected as shown below:

Column 1,
Line 57, "to." should read -- to --.

Column 2,
Line 37, "becomes" should read -- becoming --; and
Line 38, "extent" should read -- extend --.

Column 6,
Line 35, "be comer short," should read -- become shorter, --; and
Line 42, "with" should be deleted.

Column 7,
Line 35, "vomits" should read -- discharge --;
Line 45, "a" should read -- an --;
Line 47, "maintenance-free" should read -- maintenance-freedom --;
Lines 60 and 63, "in respect of" should read -- with respect to --.

Column 8,
Line 5, "is" should read -- are --; and
Line 39, "other time" should read -- a time other --.

Column 9,
Line 4, "not" should read -- not be --.

UNITED STATES PATENT AND TRADEMARK OFFICE

CERTIFICATE OF CORRECTION

PATENT NO. : 6,847,797 B2
DATED : January 25, 2005
INVENTOR(S) : Tadayoshi Nishihama It is certified that error appears in the above-identified patent and that said Letters Patent is hereby corrected as shown below:

Column 10,
Line 5, "that" should read -- that: --; and
Line 36, "with" should be deleted.

Signed and Sealed this

Thirtieth Day of August, 2005

JON W. DUDAS
*Director of the United States Patent and Trademark Office*